United States Patent [19]

Demirel et al.

[11] 4,290,252

[45] Sep. 22, 1981

[54] BASEMENT WATERPROOFING SYSTEM

[75] Inventors: Turgut Demirel; Richard L. Handy, both of Ames, Iowa

[73] Assignee: Iowa State University Research Foundation, Inc., Ames, Iowa

[21] Appl. No.: 91,362

[22] Filed: Nov. 5, 1979

[51] Int. Cl.[3] ..... E02D 27/00

[52] U.S. Cl. ..... 52/742; 52/169.14

[58] Field of Search ..... 52/169.14, 742; 405/263, 265; 166/292

[56] References Cited

U.S. PATENT DOCUMENTS

| | | | |
|---|---|---|---|
| 2,019,908 | 11/1935 | Kennedy | 405/263 |
| 2,081,541 | 5/1937 | Joosten | 405/263 |
| 2,162,185 | 6/1939 | Sourwine | 405/263 |
| 2,190,003 | 2/1940 | Van Hulst | 405/265 |
| 2,274,566 | 2/1942 | Sullivan | 405/263 |
| 2,899,329 | 8/1959 | Lyons | 405/263 |
| 3,236,671 | 2/1966 | Dybalski | 405/265 |
| 3,490,241 | 1/1970 | Kahn | 405/263 |
| 3,950,179 | 4/1976 | Schneider | 405/263 |
| 4,211,050 | 7/1980 | Cvacho | 52/169.14 |

FOREIGN PATENT DOCUMENTS

| | | | |
|---|---|---|---|
| 129289 | 9/1948 | Australia | 405/263 |
| 2396837 | 3/1979 | France | 405/263 |
| 932726 | 7/1963 | United Kingdom | 405/265 |
| 628209 | 9/1978 | U.S.S.R. | 405/263 |

*Primary Examiner*—Price C. Faw, Jr.
*Assistant Examiner*—Henry E. Raduazo
*Attorney, Agent, or Firm*—Zarley, McKee, Thomte, Voorhees & Sease

[57] ABSTRACT

A method of waterproofing subterranean walls which generally comprises peeling back the sod, making a perimeter trench around the wall, making a plurality of spaced apart vertical bore holes in the soil adjacent said wall, introducing a highly ionic inorganic salt solution into the bottom of said holes without contacting the side walls of said holes, and thereafter filling the bore holes and the trench with asphaltic emulsion, and finally placing the sod back over the trench.

8 Claims, 3 Drawing Figures

BASEMENT WATERPROOFING SYSTEM

BACKGROUND OF THE INVENTION

This invention relates to a particular system for controlling water seepage into basements, an age-old problem. In many areas of this country, basements and other subterranean block structures are excavated below the level to which the soil is naturally saturated. This level is commonly called the ground water table. Whenever the walls are lower than ground water table, a natural tendency for seepage into the subterranean structure will occur.

The most common procedure for controlling seepage into basement walls and the like is by use of drain tile installed along the footings, and by use of sump pumps as well. The purpose of tile drains and sump pumps, if they are employed, is of course, to draw the ground water table down to a lower level and thereby minimize or prevent leakage.

The use of drain tiles and sump pumps is essentially a subsoil draining procedure. Surface water is often drained away from the structure by building up and sloping the soil adjacent to the structure.

Finally, another often employed technique for controlling seepage involves introducing a waterproofing layer to the outside of the vertical walls before the excavation next to the wall is backfilled with soil. Such waterproofing often is in the form of bituminous mastic compositions, and in some instances plastic sheeting material placed over the wall.

Despite all of these precautions many subterranean wall structures, such as basements, continue to leak causing distress to homeowners, eventually damage to the wall and often times damage to carpets, furniture and other household furnishings due to water and excess humidity.

This invention has as its primary object the provision of a new waterproofing system for subterranean walls.

A more specific object of the invention is to provide a waterproofing system which can be used to successfully treat subterranean walls which have developed leaks over the years in a manner which quickly, economically and efficiently minimizes, if not substantially eliminates, such leakage problems.

Yet another object of this invention is to provide a waterproofing system which can be used quickly and efficiently without the necessity for highly skilled labor.

An even more specific object of this invention is to provide a procedure which plugs flow channels of water with a hydrophobic material thus decreasing the wetability of surrounding soil.

The method by which each of these objects, as well as others, can be accomplished will be apparent from the detailed description which follows below.

DETAILED DESCRIPTION OF THE INVENTION

Figures 1, 2, 3:
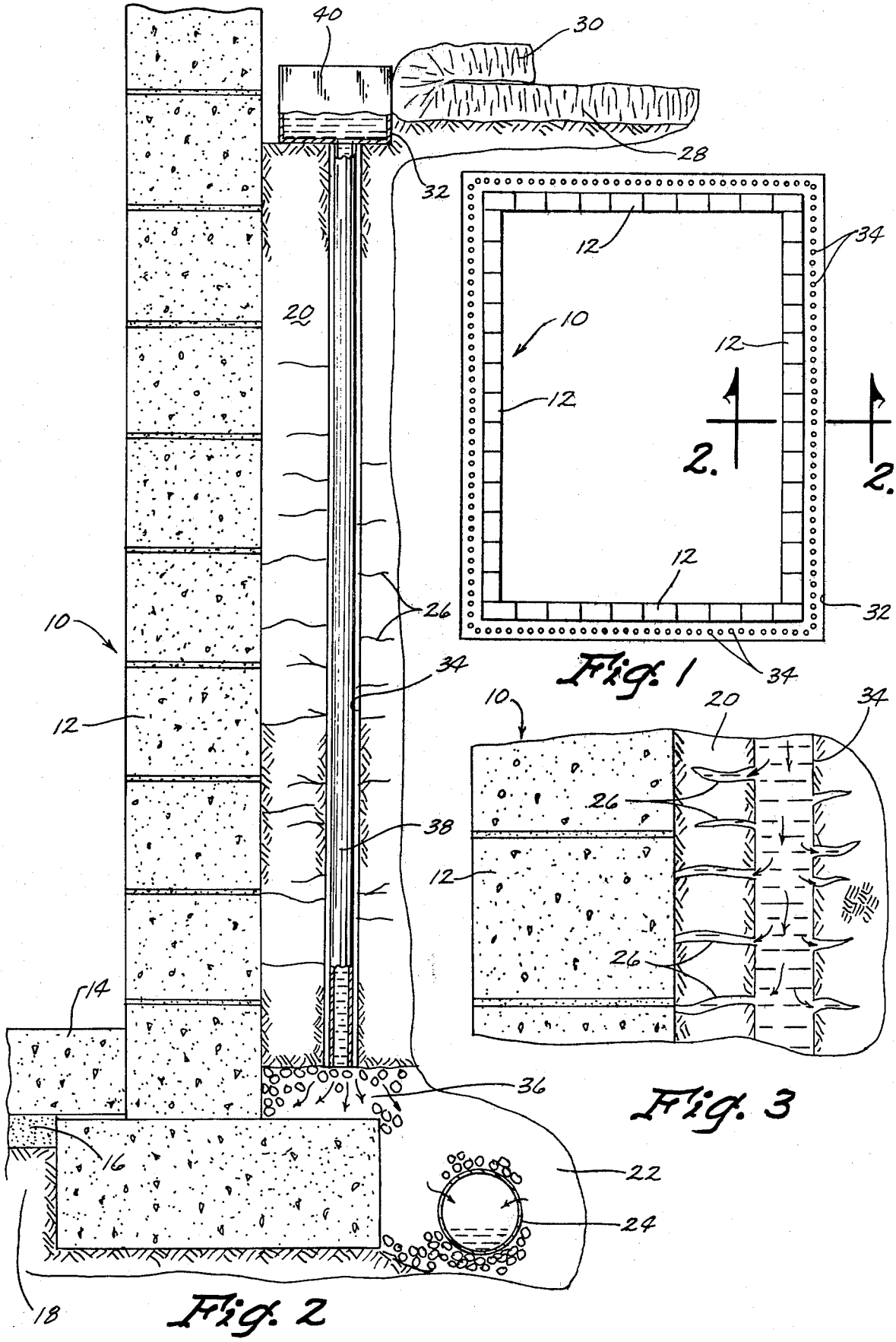
FIG. 1 is a plan view of the same basement shown in FIG. 2, ready for performing the waterproofing process of this invention.
FIG. 2 is a side elevational view, partially in section along line 2—2 of FIG. 1, showing the subterranean wall of a basement, as well as surrounding soil, with vertical bore holes necessary for performing the process of this invention.
FIG. 3 is a fragmentary view, showing sealed ground cracks with the inset pipe removed from the vertical bore holes.

The waterproofing techniques commonly used, at times can become ineffective. For example, backfilled soil at the surface is loose and allows water to quickly infiltrate. Compaction of the soil on the other hand, will cause considerable transfer of stress to the wall and often times easily dislocate the wall inwardly.

In addition, roof drainage often causes concentration of water precisely at the interface of the soil and the upper portions of a subterranean wall. And so a substantial portion of a driving rain is deposited on the ground immediately adjacent to the basement wall.

Waterproofing applied to the outside of the walls often becomes ineffective if not sealed or because of normal weathering, freezing, thawing and the like, causing stress and strain resulting in puncturing or cracking of the membrane. For example, puncturing of such a sealing plastic membrane is common during backfilling operations.

The present invention is intended as a remedial measure to be used after leakage is observed. However, it may also be used as a preventative measure. For clarity of description, it will be described in connection with the drawings. Looking first at FIG. 1, there is shown a typical subterranean wall 10 generally comprised of courses of block 12. On the interior surface is a concrete floor 14 resting on top of a layer of sand 16. Beneath sand layer 16 is earth or soil 18.

Surrounding the perimeter vertical wall 10 on its exterior is soil 20. At the lower end of wall 10 is a perimeter of gravel backfill 22, typically for drainage purposes. Imbedded in granular backfill 22 around the lower portion of vertical wall 10 is drainage tile 24. As shown in FIG. 1, a series of soil cracks 26 caused by normal wear and tear often occur adjacent vertical wall 10. It is these cracks 26 which significantly increase the risk of moisture seepage into the interior portion of subterranean wall 10.

In accordance with the process of this invention, assuming a subterranean wall 10 as depicted in FIG. 1 which is leaking, the sod 28 adjacent wall 10 is folded back as shown at 30 to define a perimeter area which is dug out to define trench 32 adjacent wall 10.

A series of vertical bore holes 34, for example of one and one-half inch diameter, are made on one foot centers around the perimeter of wall 10 down to the footing depth 36.

It is necessary, to prevent the sealing compound which is later inserted into bore holes 34 from plugging drain tile 24, since if plugging occurred, moisture drainage away from vertical wall 10 would be inhibited, thus defeating the purpose of the invention.

It has been found that plugging of drain tile 24 can be prevented by insertion into bottom portion of bore hole 34 of highly ionic water solution of an inorganic salt. As will be explained hereinafter, it is necessary that the highly ionic solution of the inorganic salt be prevented from contacting the interior wall surface of bore hole 34 since doing so would adversely affect the sealing effect caused by later applied asphaltic emulsion.

Therefore, it is necessary that the ionic solution be inserted through a tube 38 which is inserted into bore hole 34. Tube 38 can be polyvinyl chloride, polyethylene or other plastic tubular members. The precise material of which tube 38 is constructed is not important. The important factor is that tube 38 effectively insulate the interior wall of bore 34 from contact with the highly ionic inorganic salt solution, except for at the bottom.

Suitable highly inorganic salt solutions can be found in Group II and Group III metal salt solutions, such as calcium chloride, barium chloride, stronchim chloride, aluminum chloride, as well as others. It is preferred that the salt be highly water soluble salt of at least divalent metal. The most preferred salts are calcium chloride salts and aluminum chloride salts because of ease of availability and economic considerations.

The concentration of the salt solution is not critical, but the important criteria is that it freely disassociate into a highly ionic form with the more free ions available being the best.

Concentration of the solution is not critical, except that very weak concentrations are unsatisfactory. Most satisfactory concentrations are those providing the most free ions. Therefore, the more near that the solution approaches saturation, the more free ions are available and therefore the more preferred is the solution. Experience has proven that most satisfactory results are achieved when the inorganic salt solution is one which has a molar concentration equal to at least 50% of saturation.

In this first step, the tube 38 is inserted into bore hole 34 and the highly ionic inorganic salt solution is poured into the interior of tube 38. The solution gravitationally flows down tube 38 into the bottom of bore hole 34 and saturates the surrounding soil adjacent tile 24. In this manner, the walls of bore hole 34 are protected from contact with the inorganic salt solution 34.

Thereafter, tube 38 is removed from bore hole 34.

In the next step of the invention, emulsified hydrophobic material is poured into trench 32 and bore 34 until the same are substantially completely filled. The emulsified hydrophobic material can be a latex material, or for example asphaltic emulsion. Asphaltic emulsion is most highly preferred.

As those skilled in the art know, asphalt emulsion is commercially available and is an emulsion of asphalt and water which can be commercially purchased.

Asphalt is a residual semisolid in constituency, material available from petroleum, with the predominating constituents being bitumens which occur in nature. It is a black solid or viscous liquid which will readily emulsify with water. Asphalt is hydrophobic in nature but will, with suitable emulsifying agents, readily emulsify upon agitation with water.

When an asphalt emulsion is formed, like other emulsions, emulsified particles become surrounded with an electrostatic charge. Generally, all of the particles become surrounded with like electrostatic charges with the result being that the individual particles are repelled resulting in emulsion stability.

It is this readily commercially available asphalt emulsion which is poured into bore hole 34. The emulsion travels down bore hole 34 completely filling the same as well as trench 32. In addition, the emulsion travels laterally outwardly and fills soil cracks 26.

When the emulsion reaches the bottom of bore hole 34, and comes in contact with the highly inorganic salt solution, the charges of the individual emulsion particles are neutralized by the salt solution with the result being that the asphaltic emulsion breaks. The result is that the emulsion is no longer stable and separates into an oil phase and water. This breaking of the emulsion prevents plugging of drain tile 24. In this manner, drain tiles still may be effectively used for draining away of moisture, even though asphalt has been inserted into bore hole 34 which might normally have a tendency to prevent water flow into drain tile 24.

On the other hand, the emulsion which completely fills bore hole 34 and sweeps laterally into cracks 20, contains the highly hydrophobic asphalt material. The soil itself 18 and 20 is basically hydrophilic. Gradually, over a period of time, it attracts the water from the asphalt emulsion such that the water separates from the asphalt and is rejected from the system which is now hydrophobic. As a result, the asphalt seals lateral soil cracks 26 and in addition rejects and repels water which might come into contact with it. Therefore, it can be seen that effective sealing will occur.

The following example is offered to further illustrate but not limit the process of this invention.

EXAMPLE

A home in Des Moines, Iowa known to have water leakage problems was selected. The basement extended six feet below ground level and was leaking water between the floor and the wall to such an extent that during wet seasons, the water was vacuumed up about every other day in order to prevent lifting of the tile floor. The house was about 25 years old and it was known to have wet basement problems for many years, despite having conventional footing drains.

Treatment in accordance with the waterproofing system of this invention was performed during early spring 1979. The sod was peeled back and a shallow trench dug around the perimeter of the basement. Two inch diameter holes were drilled on one foot centers around the entire perimeter in the bottom of a trench. The holes were dug to a depth of six feet. Into the bottom of each of the spaced apart vertical holes in the soil adjacent the basement wall was poured one pint of a highly ionic inorganic salt solution. The solution was poured in only after insertion into the bore hole of a plastic tube to prevent the ionic inorganic salt solution from contacting the circular walls of the bore holes. Concentration of the solution was one pound per gallon of calcium chloride dissolved in water. After the salt solution was inserted, the plastic tubes were removed and about 1.5 gallons of rapid setting asphalt emulsion (designated as CRS-2) was then poured into each hole filling the same.

It was noticed that with respect to some of the holes, the emulsion level dropped rapidly, indicating flow into a void or permeable soil layer. These holes were refilled two more times. The trench was also filled with asphalt emulsion.

As an accessory aid to this treatment, the ground immediately adjacent to the wall was built up to deflect surface water away from the wall. Since the spring of 1979, the basement has been observed. The spring and summer of 1979 has been very damp in the Des Moines area. Despite this damp spring and summer, seepage of water into the basement was stopped and the basement has remained dry in spite of several months of unusually rainy weather.

It can therefore be seen that the invention accomplishes at least all of its stated objects.

What is claimed is:

1. A method of waterproofing subterranean walls, comprising:

making a plurality of spaced apart vertical holes in the soil adjacent said wall but yet spaced away from said wall;

introducing a highly ionic inorganic salt solution into the bottom portion of said holes without contacting the sidewalls of said holes; and thereafter, filling said bore holes and associated soil cracks with asphalt emulsion to impregnate the soil and seal the same.

2. The method of claim 1 wherein said salt solution is a solution of a divalent or polyvalent metal salt.

3. The method of claim 1 wherein said salt is selected from calcium salts and aluminum salts.

4. The method of claim 4 wherein said salt is calcium chloride.

5. The method of claim 1 wherein said salt solution is at a concentration level of at least one half of saturation.

6. The method of claim 1 wherein, prior to introduction of said salt solution, a tube is inserted into said vertical holes, and said solution is poured through said tube.

7. The method of claim 1 wherein as a first step, a trench is dug adjacent to, but around the perimeter of said wall, and said vertical holes are made in said trench.

8. The method of claim 7 wherein said trench is also filled with asphalt emulsion.

* * * * *